United States Patent [19]

Hobbs

[11] 4,104,559

[45] Aug. 1, 1978

[54] ISOPOLAR MAGNETRON SUPPORTED WITH RIGID INSULATION IN A REMOTE HOUSING

[75] Inventor: David Hobbs, Belmont, Mass.

[73] Assignee: Microwave Associates, Inc., Burlington, Mass.

[21] Appl. No.: 737,076

[22] Filed: Nov. 1, 1976

[51] Int. Cl.[2] ..... H01J 25/50

[52] U.S. Cl. ..... 315/39.51; 315/39.71; 315/39.75; 315/39.77; 313/287

[58] Field of Search ..... 315/39.51, 39.75, 39.77, 315/39.71; 313/289, 252, 232

[56] References Cited

U.S. PATENT DOCUMENTS

| | | | |
|---|---|---|---|
| 2,513,933 | 7/1950 | Gurewitsch | 315/39.51 |
| 3,076,122 | 1/1963 | Kumpfer | 315/39.75 X |
| 3,392,308 | 7/1968 | Cook | 315/39.71 X |

*Primary Examiner*—Saxfield Chatmon, Jr.
*Attorney, Agent, or Firm*—Alfred H. Rosen

[57] ABSTRACT

A microwave magnetron assembly in which the anode cathode and magnetic flux providing structures can be electrically insulated each from one or both of the others, and from ground potential; a housing surrounds and is spaced from the entire assembly, and a rigid insulating material fills the space between the housing and the assembly. The housing can be made of a material having magnetic shielding properties.

11 Claims, 6 Drawing Figures

ISOPOLAR MAGNETRON SUPPORTED WITH RIGID INSULATION IN A REMOTE HOUSING

This invention relates to microwave magnetrons, more particularly to the type of magnetron that is characterized by an anode structure having a plurality of cavities opening into a cathode space, a cathode structure in the cathode space, and means for providing a magnetic flux between the anode structure and the cathode.

In typical magnetrons of the type described it is usual to connect the magnetic flux producing structure to ground, and to operate the magnetron with negative-going pulses applied to the cathode if the anode is grounded, or with positive-going pulses applied to the anode if the cathode is grounded. With this arrangement it is usual to couple a magnetic field forming structure, such as a large permanent magnet, to the outside of the magnetron, without having to be concerned about the presence of an electrical voltage. Thus, magnetrons of the type described have for many years been employed exterior grounded magnet structures in combination with anode-cathode structures wherein either the anode or the cathode may be electrically grounded. One consequence of that practice is that the magnet structures can influence, and be influenced by, magnetic and electrical conditions in the surrounding environment.

In the present invention a magnetron of the type described is provided in a housing enclosing entirely the anode, the cathode, and the magnetic field-forming structures, and in a manner which permits the magnetic field-forming structure to be electrically isolated from the group and from at least one of the electrode structures. Thus, in accordance with the present invention it is possible to provide a bi-polar magnetron of the type described, wherein the magnetic field-forming structure is connected to one of the electrode components and is insulated from the other of them and from ground; it is also possible to provide a magnetron of the type described wherein the anode structure is grounded, or the cathode structure is grounded, as desired. The entire magnetron assembly can be enclosed in a housing, a material of which can be chosen to shield the magnetron, magnetically, from the surrounding environment; thus not only reducing or practically eliminating undesired influences of the magnetic structure upon other apparatus or devices, but also contributing to stability and reliability of the operation of the magnetron itself by reducing or practically eliminating undesired influences upon the magnetic flux in the magnetron that might arise, for example, as the magnetron passes through different environments, as might happen if it were carried in a radar aboard an aircraft.

The invention and representative embodiments of it are described below with reference to and as illustrated in the accompanying drawings, wherein.

Figure 1:
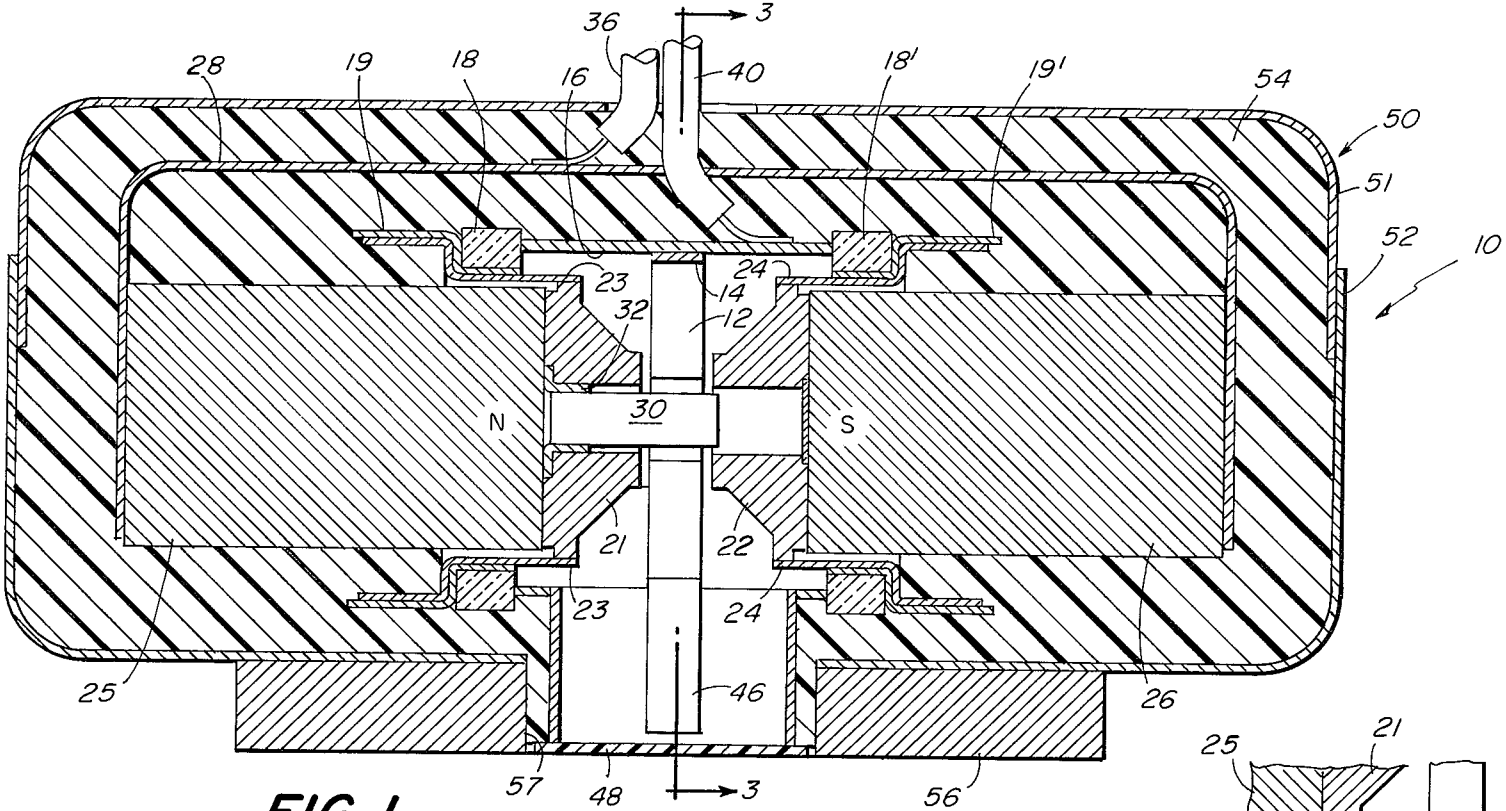
FIG. 1 is a longitudinal section through a first embodiment of the invention.
Figure 3:
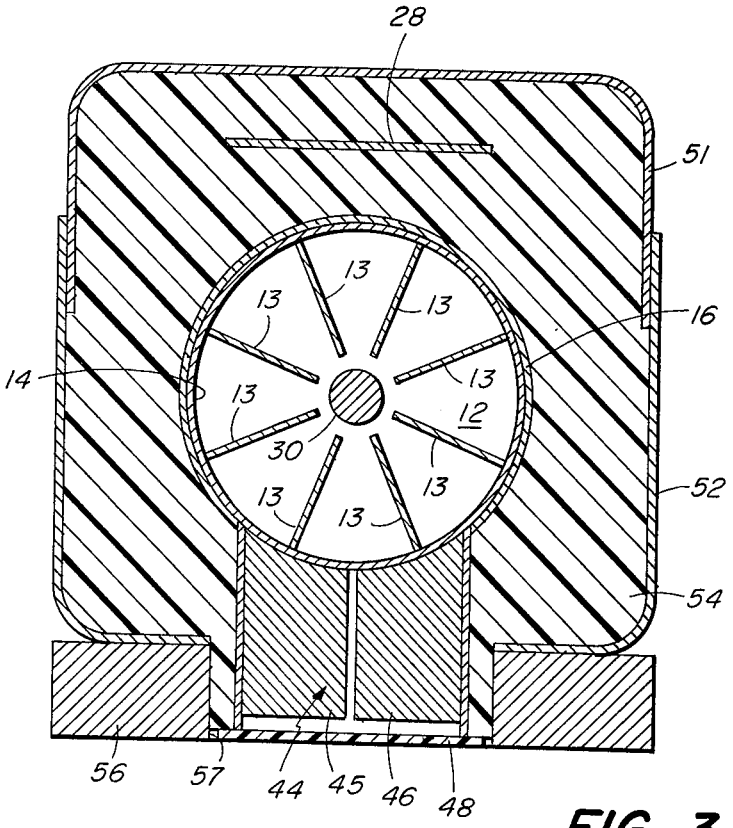
FIG. 3 is a section through line 3—3 of FIG. 1.

Referring to FIGS. 1 and 3, the magnetron 10 which is illustrated has an anode structure 12 which may take any desired multi-cavity anode form. Such anodes are well known, and, therefore, the illustration shows only a plurality of vanes 13, 13 extending from an outer ring 14 toward a cathode space 15. The anode structure is mounted within a tubular support 16 at each end of which is affixed an insulator 18, 18'. The insulators 18, 18' are annular in form, and may be made of any insulating material suitable for use in magnetrons, such as a ceramic material, and the anode support may be made of copper, for example, the insulators being affixed to the anode support by many of the known techniques such as ceramic-to-metal brazing. Electrically conductive mounting sleeves 19, 19' are also similarly permanently affixed to the insulators 18, 18', respectively, to serve as mounting means for magnetic flux producing structures.

First and second magnet pole pieces 21, 22 having respective mounting sleeves 23, 24 affixed to and supported by the anode support 16, by mating each of the pole-piece mounting sleeves 23, 24 telescopically within one of the anode-support mounting sleeves 19, 19' without necessarily requiring permanent fixation. Magnets 25, 26 appropriately poled to provide magnetic flux in the cathode space 15 are located one adjacent each of the pole pieces 21, 22, respectively, the remote ends of the magnets extending away from the pole pieces to mate with ends of a magnetic return strap 28 which not only completes the magnetic circuit but also retains the magnets 25, 26 in position mated with the pole pieces, and can serve if desired, also, to maintain the pole piece mounting sleeves 23, 24 in position within the respective anode-support sleeves 19, 19'. The magnets 25, 26 can be permanent magnets, or they can be electromagnets; permanent magnets are illustrated.

A cathode 30 is affixed at one end to the first pole piece 21 via a mounting sleeve 32 and extends toward the other pole piece 22. A cathode lead 36 is connected to the magnetic return strap 28, the cathode and magnetic flux providing structure being in this embodiment electrically connected together. No cathode heater is illustrated, inasmuch as details of a cathode heater form no part of the invention and are themselves well known.

An anode lead 40 is connected to the anode support 16. An RF output structure 44 is also connected to the anode support 16 and includes wave launching vanes 45 and 46 and an electrically non-conductive RF window 48. This is exemplary of RF wave output structures, the vanes and output housing illustrated being known as a quarter-wave transformer. Any other form of cavity-to-wave transmitting structure, such as iris coupling, coaxial, etc., may be used.

The entire magnetron assembly of FIG. 1 is supported within a housing 50 which is made of two parts 51 and 52, each of which may, if desired, be made of an electrically conductive material. The housing surrounds and is spaced from the magnetron assembly, including the magnetic return strap 28, and the interior of the housing is filled with a solid insulating material 54, such as an epoxy cement, which surrounds and rigidly supports the magnetron structure, the cathode and anode leads 36, 40 and the RF output structure 48.

A terminal block 56 for mating with a waveguide, or other wave-transmitting structure, having an aperture 57 for the RF output structure is affixed to the housing 50 at the output structure 44. The microwave magnetron within the housing 50, that is, the assembly of anode, cathode and magnetic flux producing structures, is insulated electrically from the terminal block 56, and, therefore, insulated from ground potential in a system employing the magnetron. The housing 50, on the other hand, can be grounded independent of the magnetron assembly. It is, therefore, optional with the user to apply any desired relative potentials to the anode and cathode leads 40, 36, respectively. If the housing 50 is made of an electrically conductive material, or of a magnet shielding material, the magnets 25, 26 and pole pieces 21, 22 will not only be shielded so that they cannot influence the environment immediately around them, but also they will be shielded from influences present in the environment around them, and the result with respect to permanent magnets is that once the magnets 25, 26 are gaussed there is very little likelihood that they will be degaussed by an outside magnetic influence. Stability of the magnetic flux in the magnetron assembly will contribute to frequency reliability and stability of the magnetron.

For magnetic shielding purposes, the housing 50 can be made of metal, or of an electrical non-conductor treated to have the property of a magnetic shield. Examples of the latter are a plastic impregnated with an electrically-conductive material, such as ferrite, carbon or a metal film, or a plastic coated, as on an interior surface, with an electrically conductive material.

Figure 2:
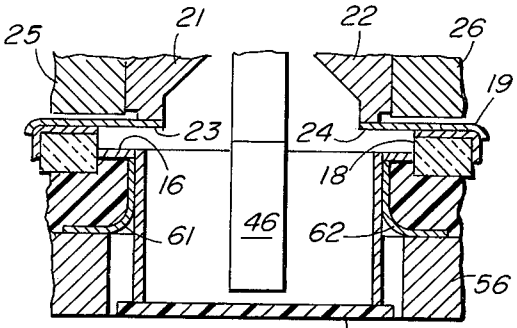
FIG. 2 is a modification of FIG. 1.

In FIG. 2 there is illustrated a modification of the embodiment of FIG. 1 wherein grounding conductors 61, 62 are connected between the anode support 16 and the terminal block 56. With this simple alteration the magnetron becomes a grounded-anode magnetron, which can be operated with negative-going pulses applied to the cathode via the magnetic return strap 28.

Figure 4:
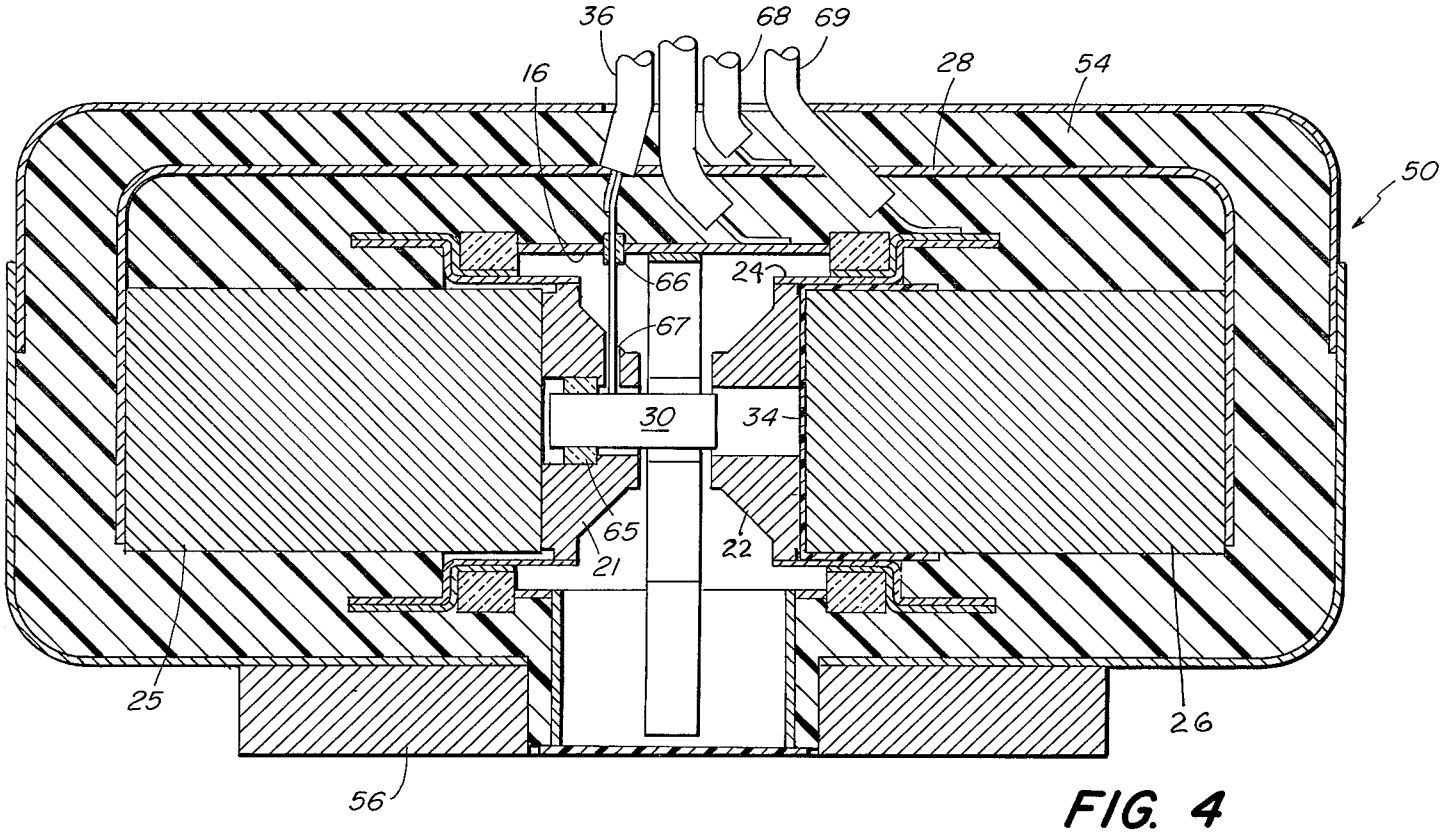
FIG. 4 is a longitudinal section through a second embodiment of the invention.

In the embodiment illustrated in FIG. 4, the cathode 30 is insulated at one end from the first pole piece 21 by means of an insulating ring 65 holding that end in a bore in the pole piece, and the second magnet 26 is insulated from the second pole piece 22 by means of an insulating sleeve 34. The cathode lead 36 is connected through an insulator 66 in the anode support 16 and a passage 67 in the pole piece 21 directly to the cathode 30. A third lead 68 is provided through the housing 50 and the insulating material 54, connected to the magnetic return strap 28. A fourth lead 69 is similarly connected to the second pole piece 22 via sleeves 19' and 24. If the potential on one pole piece is made different from the potential on the other pole piece, the potential difference between the pole pieces, or between the pole pieces and the cathode, can be used to shape the distribution of the electron population in the anode cathode space 15 to a desired configuration, for improved frequency control, mode control, efficiency, frequency tuning, and to facilitate injection locking of the operating frequency or phase.

Figure 5:
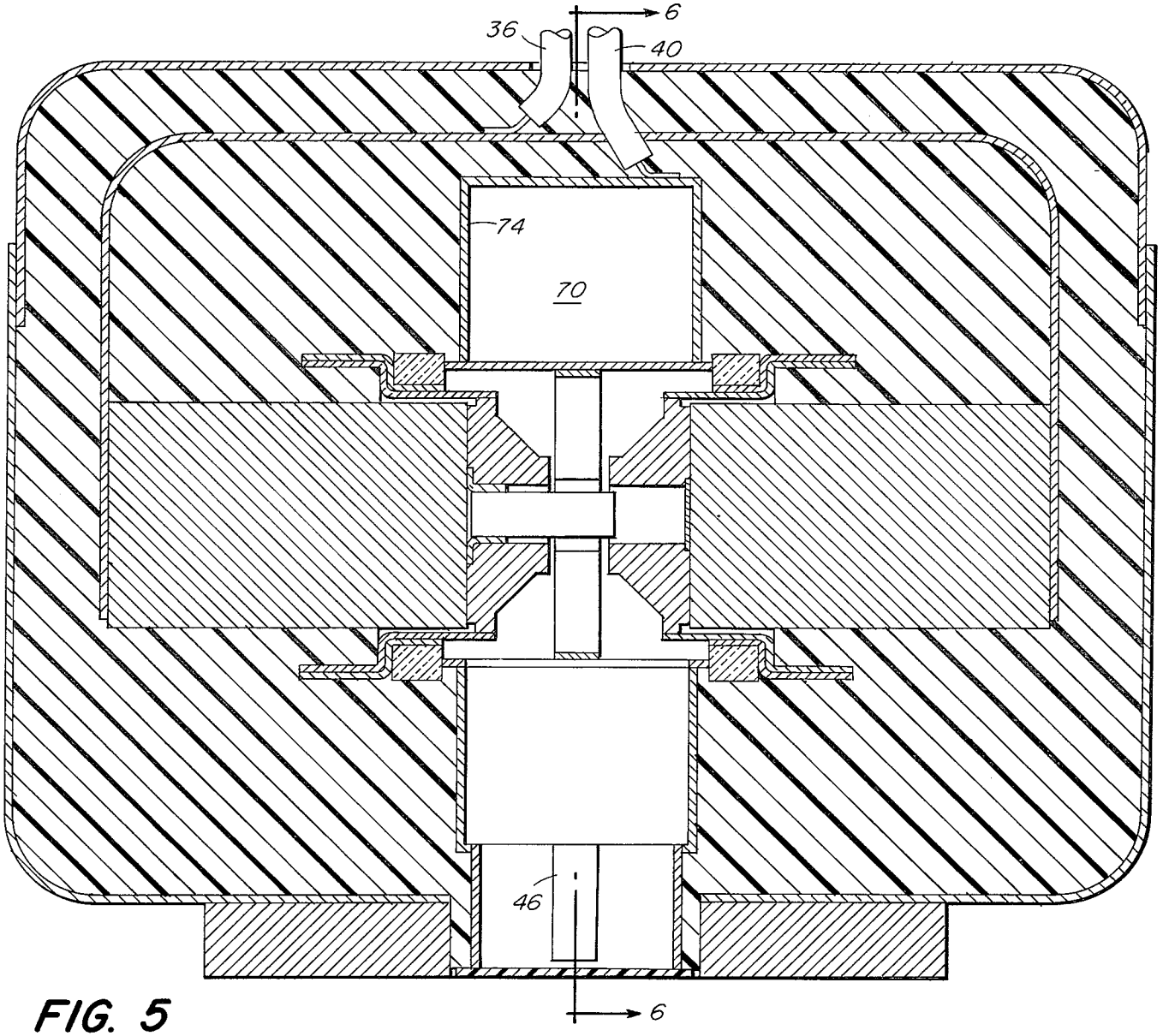
FIG. 5 is a longitudinal section through a third embodiment of the invention.
Figure 6:
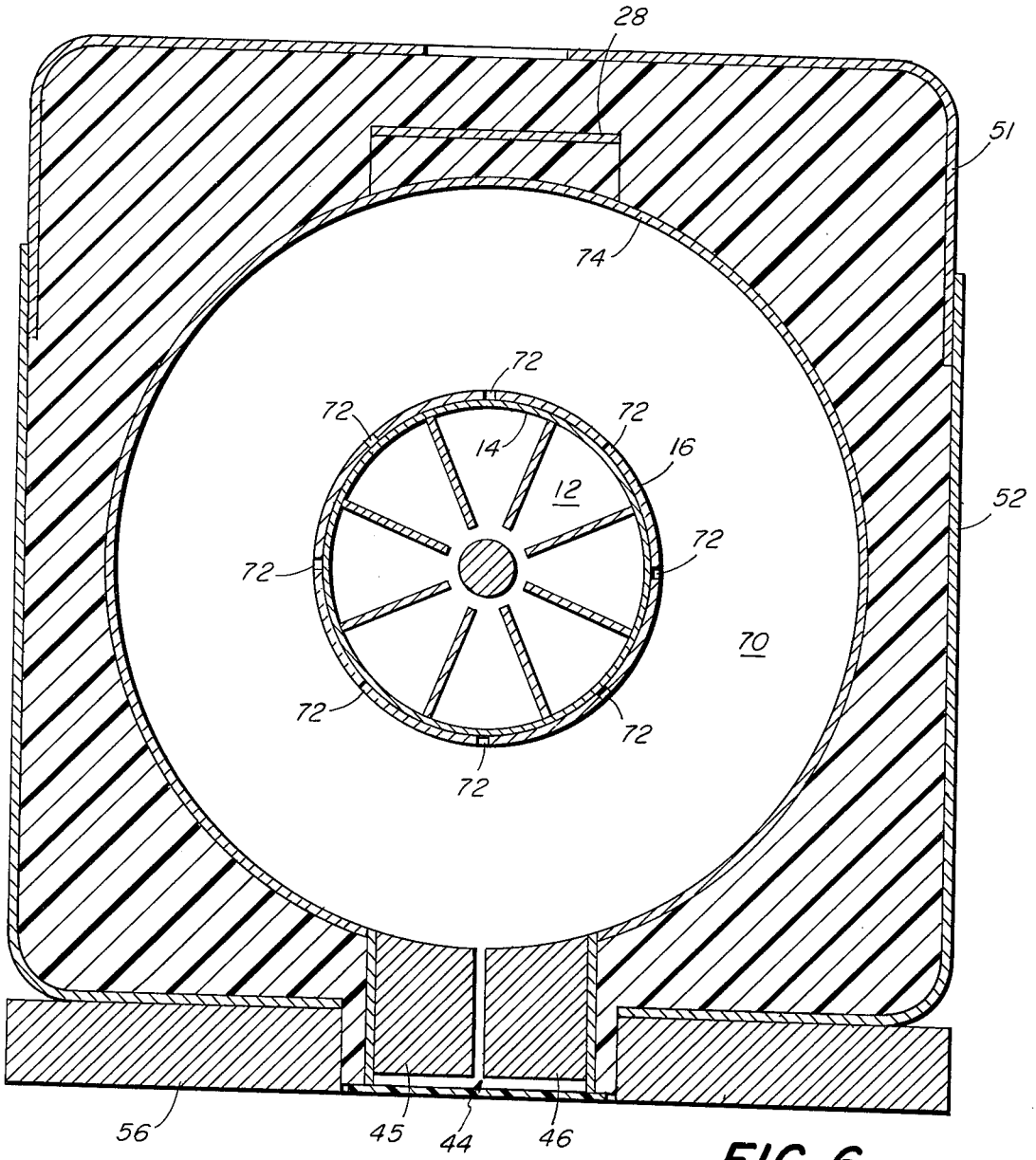
FIG. 6 is a section along line 6—6 of FIG. 5.

FIGS. 5 and 6 illustrate a magnetron similar to FIG. 1, but including additionally a circular electric mode cavity 70 surrounding the anode structure and support 12, 16. This type of magnetron is generally known as a "coaxial magnetron". Coupling apertures 72 in the anode support 16 serve to couple microwave energy from the anode 12 into the mode cavity which functions in the usual manner to establish mode stability of the magnetron during operation. The anode conductor 40 is connected to a wall 74 of the mode cavity, the walls of which are made of an electrically conductive material. The microwave energy output structure 44 is similar to that shown in FIG. 1 but the wave launching vanes 45, 46 are coupled to the electric mode cavity 70 rather than directly to the anode 12. In all other respects the embodiment of FIGS. 5 and 6 is essentially identical to the embodiment of FIGS. 1 and 3. It is, of course, understood that the features illustrated in or described with reference to the embodiments of FIGS. 1–4, respectively, can be used in the coaxial magnetron as well. In addition, there is a class of magnetrons known as "inverted circular electric mode magnetrons" wherein the cavity 70 is located centrally with the anode vanes 13 integrally connected to the outer cavity wall 74 and a large circular cathode surrounding the vanes and the cathode space 15, wherein the teaching of this invention are equally applicable.

Magnetrons according to the present invention, in any electrical configuration, whether positive-anode or negative-cathode operated, have the advantages relating to cathode structures and to electrical potentials on the cathode structures and the magnetic field structures, that are described in the publication "MICRONOTES", Vol. 3, No. 11, April/May 1966, of the assignee of this application, in a article discussing Positive Pulse Magnetrons.

I claim:

1. In a microwave magnetron of the type having a cavity-resonator anode, a cathode space, a cathode in the cathode space, and means to furnish magnetic flux in the cathode space for magnetron operation, an assembly of an anode structure comprising a generally tubular anode support having first and second ends and said cavity-resonator anode supported from said tubular anode support between said ends, output means for said magnetron coupled to said anode, a magnetic flux providing structure comprising magnetic pole pieces insulated from said anode structure for providing said magnetic flux, said cathode means extending between said pole pieces in said cathode space, a housing surrounding and spaced from said anode structure, said flux producing structure and said cathode means, and solid insulator material filling the space between said housing and said structures for rigidly supporting the same within said housing, said housing having an access passage for coupling to said output means, a first electrical connector passing through said housing and said filling material to said anode structure, and a second electrical connector passing through said housing and said filling material for connection to said cathode means.

2. Magnetron assembly according to claim 1 wherein said cathode means is electrically connected to one of said pole pieces, and said second electrical conductor is connected to said pole piece.

3. Magnetron assembly according to claim 1 including an electrical conductor within said housing from said anode support to said housing, for operating said magnetron in a grounded-anode manner.

4. Magnetron assembly according to claim 1 including an electrically-insulating support in one of said pole pieces, said cathode means being elongate with one end supported in said insulating support, said second electrical connector being connected to said cathode means within said one pole piece, and a third electrical connector passing through said housing and said filling material to at least one of said pole pieces.

5. Magnetron assembly according to claim 1 wherein said third connector is connected to one only of said pole pieces, and including a fourth electrical connector passing through said housing and said filling material to the other of said pole pieces.

6. Magnetron assembly according to claim 1 including within said housing a body of electrically-conductive wall means defining a circular electric mode cavity in coaxially cooperative relation with said anode, and electric wave coupling means between said cavity-resonator anode and said electric mode cavity, said output for said magnetron being coupled to said wall means.

7. Magnetron assembly according to claim 1 wherein said housing is made at least in part of a magnetic-field shielding material.

8. Magnetron assembly according to claim 1 wherein said housing includes an electrically-conductive material, said magnetic flux producing structure being insulated from said housing while being shielded by said housing.

9. In a microwave magnetron of the type having a cavity-resonator anode, a cathode space, a cathode in the cathode space, and means to furnish magnetic flux in the cathode space for magnetron operation, an assembly of an anode structure comprising a generally tubular anode support having first and second ends and said cavity-resonator anode support from said tubular anode support between said ends, output means for said magnetron coupled to said anode, voltage insulator means affixed one to each of said ends, a magnetic flux providing structure comprising magnetic pole piece means affixed to each of said insulator means for providing said magnetic flux and having elongate magnets extending in opposite directions from each of said pole pieces, and a magnetic return strap connecting the remote ends of said magnets around said anode structure, said cathode means extending between said pole pieces in said cathode space, a housing surrounding and spaced from said anode structure, said flux producing structure and said cathode means, and solid insulator material filling the space between said housing and said structures for rigidly supporting the same within said housing, said housing having an access passage for coupling to said output means a first electrical connector passing through said housing and said filling material to said anode support, and a second electrical connector passing through said housing and said filling material for connection to said cathode means.

10. Magnetron assembly according to claim 1 including means for applying a separate electric potential to each of said anode structure, said cathode means, and each of said pole means.

11. In a microwave magnetron having an anode, a cathode and at least two magnetic pole pieces means for providing magnetic flux, means to apply a separate electric potential to each of said anode and said cathode and to each of said pole pieces means.

* * * * *